US008863934B2

(12) United States Patent
Nikolayev

(10) Patent No.: US 8,863,934 B2
(45) **Date of Patent: *Oct. 21, 2014**

(54) DATA GENERATING DEVICE FOR BULK VENDING MACHINES

(75) Inventor: Nikolay Nikolayev, Flushing, NY (US)

(73) Assignee: Nova Resolution Industries, Inc., Bronx, NY (US)

( * ) Notice: Subject to any disclaimer, the term of this patent is extended or adjusted under 35 U.S.C. 154(b) by 188 days.

This patent is subject to a terminal disclaimer.

(21) Appl. No.: 10/722,779

(22) Filed: Nov. 26, 2003
(Under 37 CFR 1.47)

(65) Prior Publication Data

US 2008/0128242 A1 Jun. 5, 2008
US 2012/0285789 A9 Nov. 15, 2012

Related U.S. Application Data

(63) Continuation-in-part of application No. 09/571,559, filed on May 16, 2000, now abandoned, which is a continuation-in-part of application No. 09/159,160, filed on Sep. 23, 1998, now Pat. No. 6,062,370, which is a continuation-in-part of application No. 09/065,504, filed on Apr. 24, 1998, now Pat. No. 5,909,795, and a continuation-in-part of application No. 08/842,677, filed on Apr. 15, 1997, now Pat. No. 5,950,794.

(51) Int. Cl.

| | |
|---|---|
| ***G07F 5/00*** | (2006.01) |
| ***G07F 11/00*** | (2006.01) |
| ***G07F 13/00*** | (2006.01) |
| ***G07F 15/00*** | (2006.01) |
| ***G07F 17/00*** | (2006.01) |
| ***G07F 5/02*** | (2006.01) |
| ***G07F 11/02*** | (2006.01) |
| ***G07F 11/44*** | (2006.01) |

(52) U.S. Cl.
CPC *G07F 5/02* (2013.01); *G07F 11/02* (2013.01); *G07F 11/44* (2013.01)
USPC ..... 194/239; 194/255; 221/7

(58) Field of Classification Search
CPC ..... G07F 5/10; G07F 17/00; G07F 11/002; G07F 17/30; G07F 5/02; G07F 11/44; G07F 9/04; G07F 11/68; G07F 11/02; G07F 17/0092; G07F 11/62; A61J 7/0084; A61J 7/02
USPC ..... 194/215–217, 202, 219–221, 223, 230, 194/231, 235–245, 255, 292; 453/32; 221/7; 377/7; 335/93, 235
See application file for complete search history.

(56) References Cited

U.S. PATENT DOCUMENTS 1,926,652 A * 9/1933 Rosenfeld ..... 62/234
2,818,213 A * 12/1957 Pearl ..... 377/7

(Continued)

*Primary Examiner* — Jeffrey Shapiro
(74) *Attorney, Agent, or Firm* — Symbus Law Group, LLC; Clifford D. Hyra

(57) ABSTRACT

A data generating device for use with a coin mechanism of a bulk vending machine, is provided. In all of the embodiments, the invention uses a standard coin mechanism of a bulk vending machine, which in its normal operation is received into an opening in the bulk vending machine, and a data generating device in working relation with the coin mechanism. The data generating device, will be able to receive, store and generate various types of information relevant to owners/operators of bulk vending machines, including but not limited to, day and/or time of particular vends, particular machine from which the vend took place, particular location/owner/operator of machine from which each vend originated, and the identity of the person collecting the money from the machine, while also allowing for the multiple hook-up of numerous data generating devices positioned on numerous machines found in one location so as to achieve a report on all vends from all machines.

8 Claims, 10 Drawing Sheets

(56) References Cited

U.S. PATENT DOCUMENTS

| | | | | | |
|---|---|---|---|---|---|
| 3,010,557 | A | * | 11/1961 | Weitzman | 194/236 |
| 3,360,092 | A | * | 12/1967 | McConnell | 194/223 |
| 3,783,986 | A | * | 1/1974 | Bolen | 194/350 |
| 4,216,461 | A | * | 8/1980 | Werth et al. | 340/5.9 |
| 4,354,613 | A | * | 10/1982 | Desai et al. | 377/1 |
| 4,369,442 | A | * | 1/1983 | Werth et al. | 377/7 |
| 4,512,453 | A | * | 4/1985 | Schuller et al. | 194/200 |
| 4,766,548 | A | * | 8/1988 | Cedrone et al. | 700/236 |
| 4,973,387 | A | * | 11/1990 | Osterman et al. | 203/39 |
| 4,981,024 | A | * | 1/1991 | Beldham | 68/12.18 |
| 5,337,253 | A | * | 8/1994 | Berkovsky et al. | 705/22 |
| 5,360,093 | A | * | 11/1994 | Baer | 194/206 |
| 5,381,880 | A | * | 1/1995 | Pearson | 194/217 |
| 5,564,547 | A | * | 10/1996 | Ranon et al. | 194/216 |
| 5,614,892 | A | * | 3/1997 | Ward et al. | 340/870.02 |
| 5,647,471 | A | * | 7/1997 | Ra | 194/350 |
| 5,657,848 | A | * | 8/1997 | Schwarzli | 194/236 |
| RE35,649 | E | * | 11/1997 | Baer | 194/206 |
| 5,685,435 | A | * | 11/1997 | Picioccio et al. | 209/677 |
| 5,909,795 | A | * | 6/1999 | Porco et al. | 194/243 |
| 5,947,328 | A | * | 9/1999 | Kovens et al. | 221/129 |
| 5,950,794 | A | * | 9/1999 | Porco et al. | 194/239 |
| 6,050,385 | A | * | 4/2000 | Nikolayev et al. | 194/202 |
| 6,050,447 | A | * | 4/2000 | Kovens et al. | 221/125 |
| 6,182,861 | B1 | * | 2/2001 | Kovens et al. | 221/258 |
| 6,290,049 | B1 | * | 9/2001 | Nikolayev | 194/202 |
| 6,857,710 | B2 | * | 2/2005 | Bolen | 312/35 |
| RE39,234 | E | * | 8/2006 | Ostendorf et al. | 700/241 |
| RE40,588 | E | * | 11/2008 | Ostendorf et al. | 705/30 |

* cited by examiner

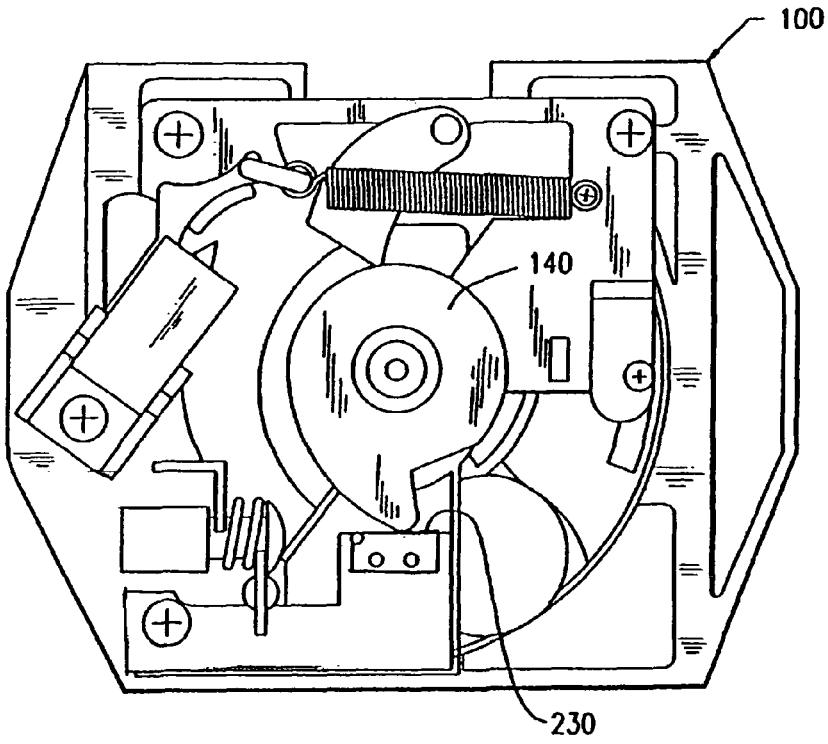
FIG. 9
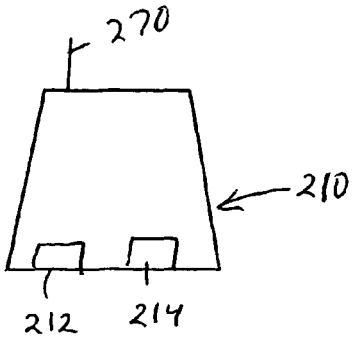

DATA GENERATING DEVICE FOR BULK VENDING MACHINES

RELATED APPLICATIONS

This application is a continuation-in-part of application Ser. No. 09/571,559 filed May 16, 2000, now abandoned, which is a continuation-in-part of application Ser. No. 09/159,160, issued on May 16, 2000 as U.S. Pat. No. 6,062,370, which was a continuation-in-part of application Ser. No. 09/065,504, issued on Jun. 8, 1999 as U.S. Pat. No. 5,909,795 and application Ser. No. 08/842,677, issued on Sep. 14, 1999 as U.S. Pat. No. 5,950,794.

BACKGROUND OF THE INVENTION

This invention relates to the field of bulk vending machines, and more particularly, to a data generating device for bulk vending machine coin mechanisms.

Both vending machines and bulk vending machines are old in the art. Vending machines are normally associated with those machines used for dispensing a particularly chosen item to a user of the machine. For example, a user of a vending machine will insert the required amount of money, represented by coins or bills, into the machine and will then have an opportunity to select from a variety of different items. These items can include different types of snacks (candy bars, potato chips, pretzels, gum, breath mints, stickers, etc.), drinks (soda, fruit juices, water, etc.) and ice cream (sandwiches, pops, cones, etc.).

In contrast, a bulk vending machine does not normally lend itself to giving the user of a machine a choice between the goods to be selected. In general, bulk vending machines hold large quantities of a particular type of item (gum balls, nuts, trail mix, toys, balls, stickers, etc.) in a large top mounted receptacle. By placing a coin into the coin mechanism of the bulk vending machine, and turning the handle, one, or a handful, of the items within the receptacle are dispensed down a chute for receipt by the user. In these machines, no choice has been given to the user, and the user will receive whichever item, or items, are next in line to be dispensed. Parents will now clearly understand the distinction between vending machines and bulk vending machines; vending machines give their child a choice and the child walks away happy and content, while bulk vending machines distribute what they want to the awaiting hands of the child, and no matter how much screaming and ranting by the child, he/she will have to eat the blue gum ball, even though he/she really wanted a green gum ball.

Another important distinction between vending machines and bulk vending machines, is that vending machines are normally AC powered units which are plugged into a wall outlet, while bulk vending machines are almost never electrically powered. This makes bulk vending machines safer to use, and allows for their placement in any location.

In the history of the bulk vending industry, there has been no effective way of (1) counting the money received into bulk vending machines or (2) displaying that information in a format which is easy to use and manipulate.

Today's standard methods for determining the amount of vends which have occurred, and the coins inserted into a given machine during a certain period of time, are by hand-held coin counters and weight scales. These methods make the collection process very time consuming and leave no hope for any sense of security, nor for the possibility of building any kind of financial history for the particular machine by the owner or lease holder of the machine.

As is evidenced by the counting mechanisms of U.S. Pat. Nos. 5,201,396, 4,392,563, 4,376,479, 4,369,442, 4,216,461 and 4,143,749, the prior art discloses attempts to insert counters, usually into vending machines, but sometimes into bulk vending machines. These prior art counters have the disadvantages of requiring a separate AC power source and the need of an associated power converter to provide the low voltage power needed to the meter. These prior art counters also disclose mechanisms for determining the value of the coins deposited and mechanisms for counting the value of the items exiting in the machine. All of these counters are hindered by deficiencies in size, power source and the complicated nature of their operation.

Additional prior art is U.S. Pat. No. 3,783,986 to Bolen, which shows a complicated counter for bulk vending machines, wherein the counter is specifically not attached to the coin mechanism of the machine, which requires a hole to be cut into the back of the machine, and which, while being a good attempt to resolve an industry-wide problem, nevertheless has a counter which is too far removed from, and connected by too many gears to, the coin mechanism.

The bulk vending industry is, despite the Bolen counter, still crying out for a small, self powered (not requiring an external AC power source) counting mechanism for its bulk vending machines. Accordingly, it would be desirable to provide a coin mechanism and/or coin mechanism and data generating device combination for a bulk vending machine which, preferably, needs no external AC power source, is sized so as to fit within the restricted space limitations of a bulk vending machine without needing to cut a hole in the machine, is accurate, is easily read, is not able to be tampered with, is easily installed and maintained, is capable of allowing the user to download the data for use in spreadsheet-like print outs and is even able to combine the information from numerous machines at a location into a single report.

SUMMARY OF THE INVENTION

In accordance with the invention, a data generating device for use with a coin mechanism of a bulk vending machine, is provided.

The invention uses a standard coin mechanism of a bulk vending machine, which in its normal operation is received into an opening in the bulk vending machine, and a data generating device in working relation with the coin mechanism. The coin mechanism has a selectively rotatable shaft extending axially therefrom, which has mounted therearound a cam, or other such eccentrically protruding member which can achieve the same result as the cam.

In a first embodiment of the invention, a pivotally mounted switch is by some manner, be it mechanical, electronic or wireless transmission, connected to the data generating device. A portion of the switch comes into contact with a portion of the cam when the cam rotates, due to the cam's eccentric shape. Alternatively, some other element of the coin mechanism which might be mounted around, on or in the rotatable shaft may be caused to come into contact with the switch, it being understood that it is the normal rotation of the coin mechanism's shaft after deposit of a coin, or coins, by a user, that is meant to trigger the pivot of the switch, and not necessarily that the cam must be the triggering element of the coin mechanism. Continuing then, it is either the eccentric rotation of the cam or the somewhat protruding rotation of another element mounted around, on or in the coin mechanism's shaft, which causes the switch to pivot thereby causing the compilation of data by the data generating device. As for example, the coin mechanism's sprocket could be used to activate the switch. Accordingly, hereinafter, throughout the remainder of this specification and the claims, the term "cam" shall be defined as any of the above cam or cam-like devices which are mounted around, on or in the shaft of the coin mechanism and come into contact with the switch so as to cause the compilation of data by the data generating device.

In a second embodiment of the invention, the pivotally mounted switch is replaced by a reed-switch assembly. The reed-switch assembly is comprised of first and second arms, the first arm having a reed-switch thereon and the second, pivotal arm having a magnet mounted thereon. By the rotation of the cam, the second arm is caused to pivot so that the magnet found thereon is moved to a position close to the reed-switch found on the first arm thereby activating the reed-switch and causing the compilation of data by the data generating device.

In a third embodiment of the invention, the reed-switch is now mounted to the coin mechanism in a position so that the rotation of the cam comes close to the reed-switch. Since the cam has a magnet attached to it at, or near, the area coming closest to the reed-switch upon its rotation with the coin mechanism's shaft, the magnet causes the reed-switch to "close", thereby causing the compilation of data by the data generating device.

A fourth embodiment of the invention replaces the magnet on the cam of the third embodiment, with a piece of metal, and further replaces the reed-switch of the third embodiment with an inductive coil. The coil has a magnetic field which is varied or disrupted when the piece of metal gets close thereby causing the compilation of data by the data generating device.

Accordingly, it is an object of the invention to improve a standard bulk vending machine coin mechanism by placing it in combination with a data generating device.

Still another object of the invention is to improve a standard bulk vending machine coin mechanism through placement of the combination coin mechanism and data generating device within the limited space provided in a bulk vending machine.

Yet another object of the invention is to improve a standard bulk vending machine coin mechanism by providing a data generating device which is not powered by an outside AC power source.

Still a further object of the invention is to provide security and peace of mind to the owner/lease holder of bulk vending machines by enabling them to have independent, accurate and non-tamperable results of the counting of coins deposited into all of their bulk vending machines.

Other objects of the invention will in part be obvious and will in part be apparent from the following description.

The invention accordingly comprises assemblies possessing the features, properties and the relation of components which will be exemplified in the products hereinafter described, and the scope of the invention will be indicated in the claims.

BRIEF DESCRIPTION OF THE DRAWINGS

For a fuller understanding of the invention, reference is made to the following description taken in connection with the accompanying drawings, in which:

FIG. 9 is a rear elevational view of the device of FIG. 6, without the coin mechanism's sprocket and showing the cam activating the switch of the data generating device.

DETAILED DESCRIPTION OF THE PREFERRED EMBODIMENTS

Figure 1:
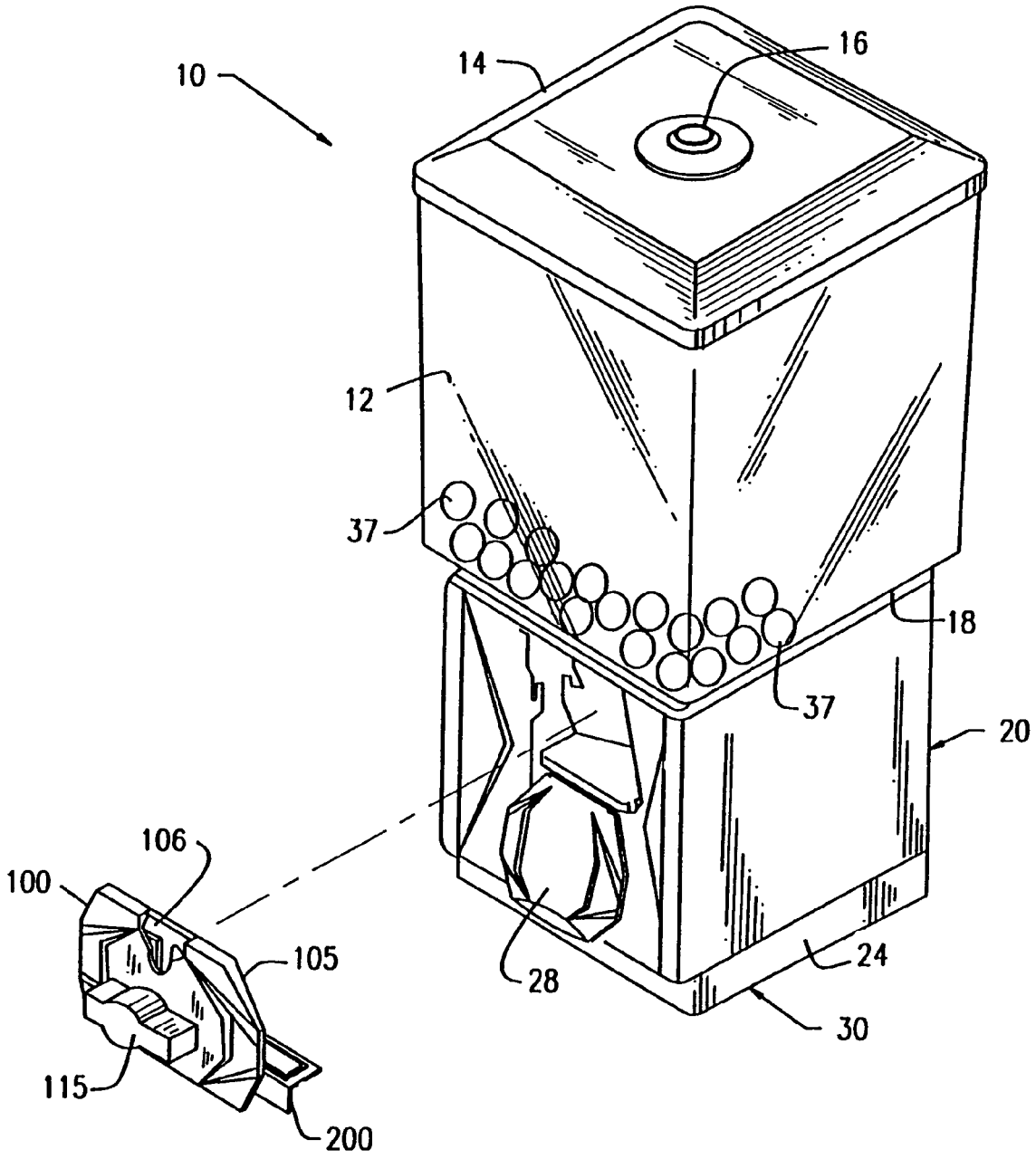
FIG. 1 is a perspective view of a bulk vending machine with an exploded view of the preferred placement of the coin mechanism and data generating device.
Figure 2:
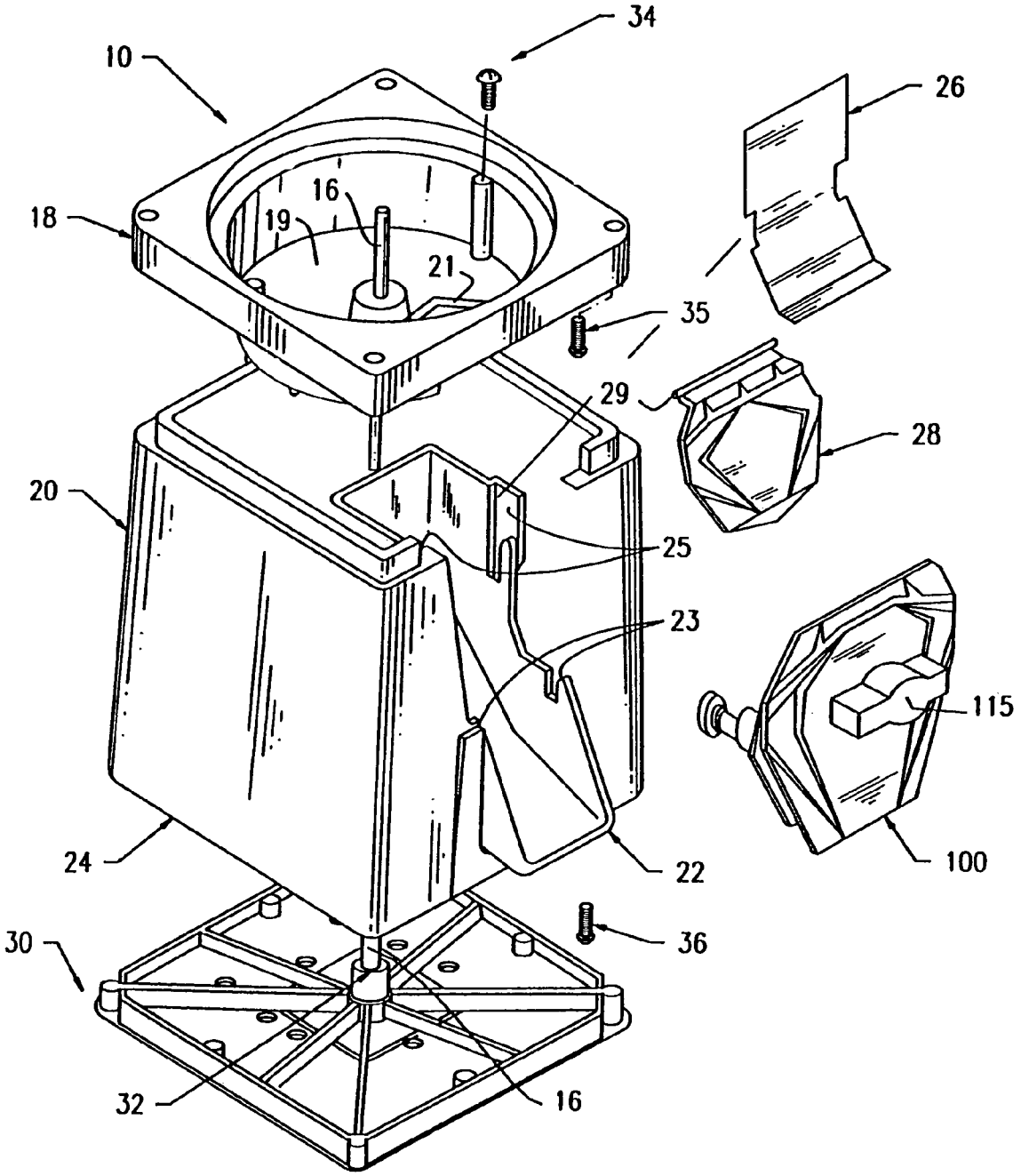
FIG. 2 is an exploded perspective view of a second embodiment of a bulk vending machine.

Referring first to FIGS. 1 and 2, two different, although very similar looking, bulk vending machines are shown at 10. Bulk vending machine 10 of FIG. 1 shows a fully constructed machine, having a top bulk receptacle 12 having a lid 14 and a bolt 16. The base of both machines 10 have a hopper 18, a body 20, a dispensing chute 22, a coin retainer base 24, a chute shield 26, a chute cover 28 and a coin mechanism 100.

In general, machine 10 has a base 30 into which bolt 16 extends to be secured by nut 32.

Receptacle 12 is held to hopper 18 by screws 34. Coin retainer 24 is held to the bottom of base 20 by screws 36. Chute shield 26 is secured onto chute 22 in notches 25, while chute cover 28 is rotatingly secured to chute 22 by rod 29 of cover 28 resting within notches 23 of chute 22.

Hopper 18 has a base 19 into which dispensing materials (for example, gum balls 37, see FIG. 1) are placed.

Hopper 18 has an opening 21 extending through base 19. Opening 21 is the passageway through which gum balls 37 pass to exit machine 10 through chute 22. As will be discussed in more detail below with regard to FIG. 3, coin mechanism 100 has a sprocket 150, which when rotated due to a user of machine 10 turning handle 115 of coin mechanism 100, causes a product wheel (not shown) to rotate. The product wheel has at least one opening which for each rotation of handle 115 corresponds with opening 21 of hopper 18, to allow for dispensing of one gum ball 37, or multiple quantities of such items as nuts, trail mix, M&Ms, etc.

Figure 3:
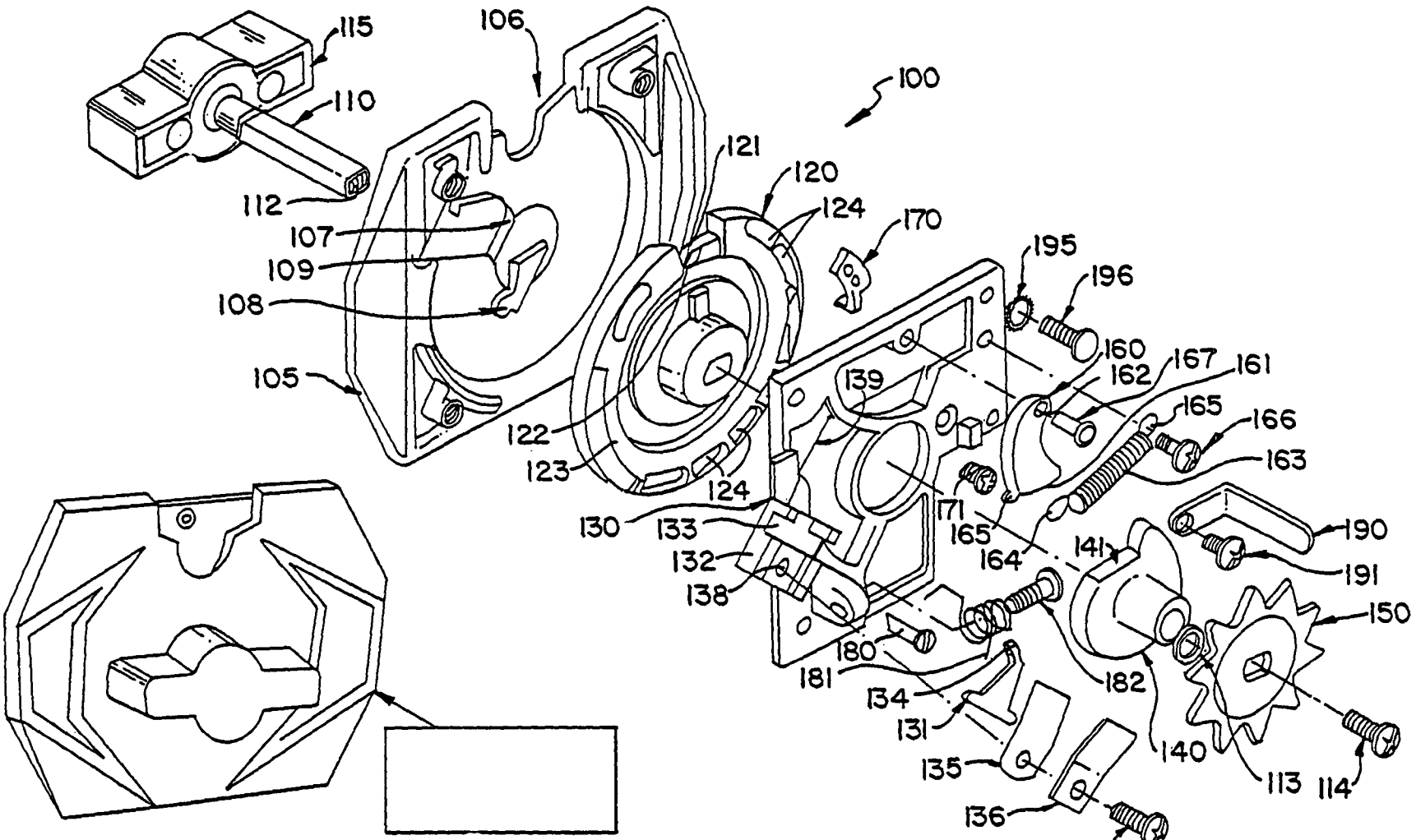
FIG. 3 is an exploded perspective view of the workings of a bulk vending machine coin mechanism.
Figure 4:
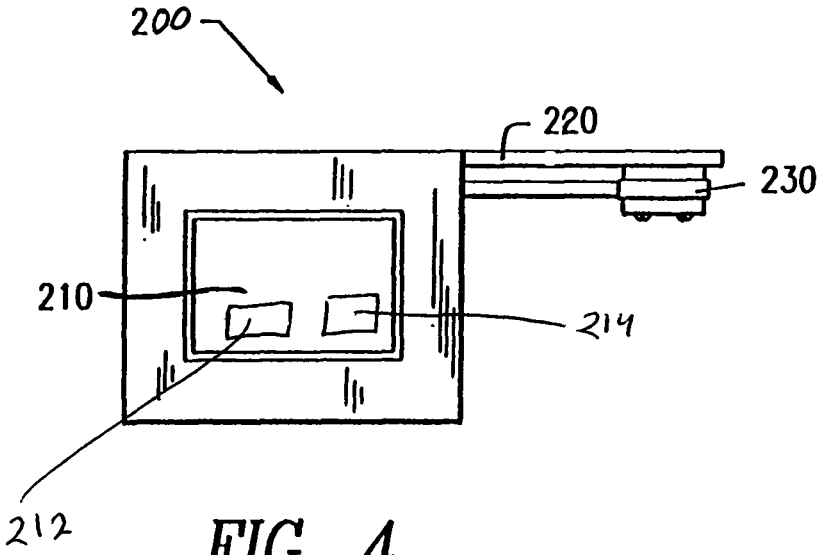
FIG. 4 is a top plan view of a data generating device made in accordance with the invention.
Figure 5:
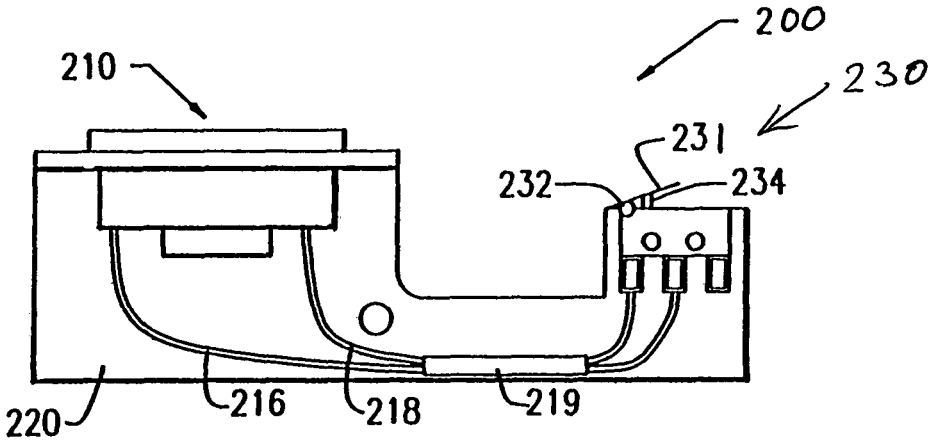
FIG. 5 is a front elevational view of the data generating device of FIG. 4.

Turning now to FIG. 3, an exploded view of a standard coin mechanism for a bulk vending machine is shown at 100. It is to be understood that the use of differently constructed coin mechanisms is anticipated by the invention.

Coin mechanism 100 has a front plate 105, shaft 110, handle 115, coin wheel 120, back plate 130, cam 140 and sprocket 150. Shaft 110 is axially located through all of the stated elements, and secures said elements together through use of threads 112 in shaft 110 and washer 113 and nut 114. At the end of shaft 110, opposite threads 112, is handle 115. As seen earlier in FIGS. 1 and 2, handle 115 is one of the few parts of coin mechanism 100 which is exterior to bulk vending machine 10, and is the part that a user of bulk vending machine 10 uses after insertion of coins to receive his/her treat.

Continuing with FIGS. 1 and 3, front plate 105 of coin mechanism 100 has a coin receiving slot 106. In use, a user of bulk vending machine 10 inserts a coin (usually a quarter) into slot 106 of front plate 105. Once the quarter is inserted through slot 106, it comes to rest within slot 121 of coin wheel 120 (see FIG. 3), where it sits upon curved ridge 122. In its position on curved ridge 122, a quarter will turn with coin wheel 120 when handle 115 is rotated. It is the positioning of a coin within coin wheel 120, which, based upon the size of the coin, will allow coin wheel 120 to freely rotate thereby allowing cam 140 to correspondingly rotate to activate counter 200 (see FIGS. 1 and 4-9) (to be discussed below).

In operation, coin mechanism 100 operates as follows:

1. As previously discussed, a coin is placed within slot 106 of front plate 105, to rest upon curved ridge 122 of slot 121 of coin wheel 120.

2. Handle 115 is rotated in a clockwise direction where the coin undergoes its first test of authenticity. The coin first comes into contact with coin pawl spring 107 and coin pawl 108. As coin wheel 120 is rotated, the coin pushes end 109 of coin pawl spring 107 upward. Assuming the coin has a proper diameter, end 109 of coin pawl spring 107 will sufficiently rise, thereby disengaging coin pawl 108 from locking coin wheel 120 in position. Coin wheel 120 will thereafter be free to continue its clockwise rotation.

3. The coin next encounters washer pawl 131, which is secured within washer pawl mount 132, having a receiving notch 133.

Washer pawl 131 is held within slot 133 of mount 132 by washer pawl spring 135, washer pawl retainer 136 and washer pawl retainer screw 137. Washer pawl retainer screw 137 screws into mount 132 at threaded opening 138. When secured in place, washer pawl 131 has its end 134 extending through opening 139 of back plate 130. While coin pawl 108 was responsible for authenticating the diameter of the coin, washer pawl 131 is the item which authenticates the thickness of the coin.

In operation, end 134 of washer pawl 131 runs against inside surface 123 of coin wheel 120. As can be seen at slot 121, with no coin in coin mechanism 100 (if for some reason coin wheel 120 somehow turned passed coin pawl 108), coin wheel 120 would be prevented from turning further due to end 134 of washer pawl 131 entering into slot 121 of coin wheel 120. In this position, slot 121 would hit against end 134, causing coin wheel 120 to halt in its rotation. Similarly, if the thickness of the coin was too thin, end 134 would slide off of surface 123 down to the surface of the coin, and would again touch part of slot 121, preventing further rotation of coin wheel 120. In contrast, if the coin were too thick, end 134 of washer pawl 131 would hit into the edge of the coin, and coin wheel 120 would at that point be prevented from rotating further. Only when the coin is of the proper thickness, will end 134 run smoothly between surface 123 and the surface of the coin, thereby allowing coin wheel 120 to continue its rotation.

4. The final pawl of coin mechanism 100 is return pawl 160. Return pawl 160 has a bottom side 161 and a substantially curved side 162. When cam 140 is in its resting position (between uses), it is the position shown in FIGS. 3 and 8. In this position, surface 161 of return pawl 160 rests upon flat surface 141 of cam 140.

Figure 8:
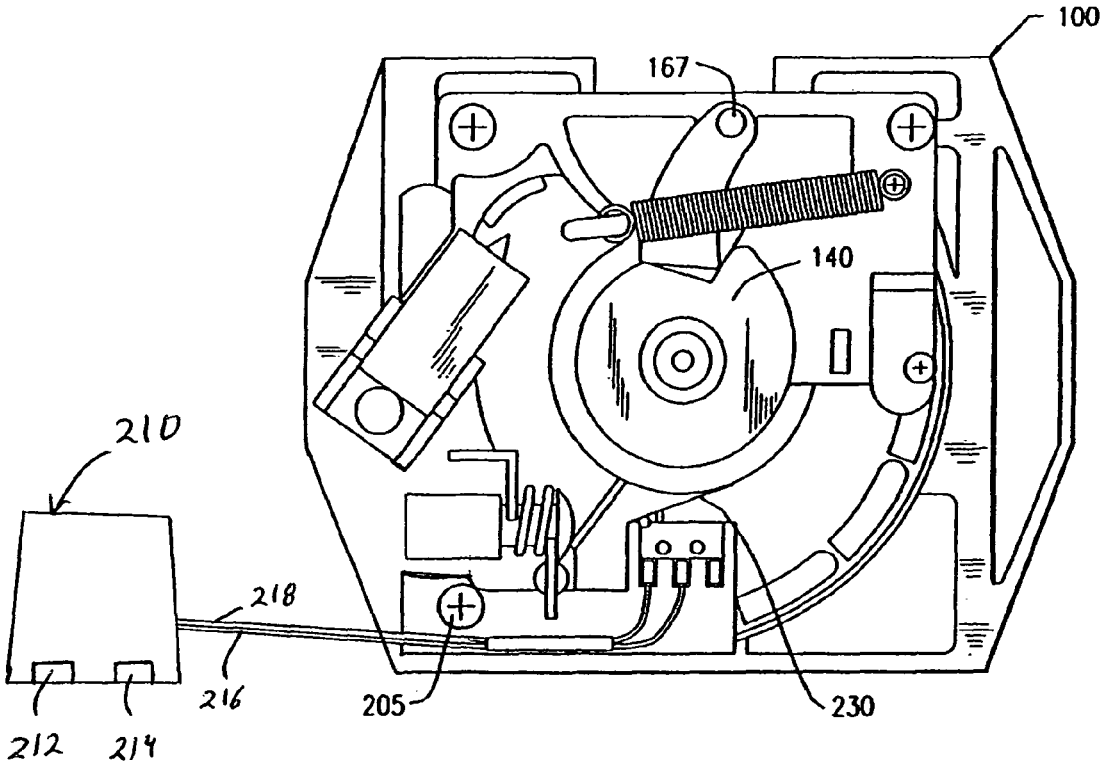
FIG. 8 is a rear elevational view of the device of FIG. 6, without the coin mechanism's sprocket and showing the cam in its at rest position.

Return pawl 160 is pulled into its at rest position shown in FIGS. 3 and 8 by spring 163 having first and second loops 164 and 165. Loop 164 is received around protrusion 165 of return pawl 160, and spring 163 is secured to back plate 130 by screw 166. Accordingly, tension from spring 163 maintains return pawl 160 in its at rest position, as shown in FIG. 8.

Return pawl 160 is riveted into back plate 130 by return pawl rivet 167, to enable return pawl 160 to pivot.

5. Attached at the end of shaft 110, between cam 140 and bolt 114, is sprocket 150, which as previously discussed, turns the product wheel (not shown) which allows for the dropping of treats, such as gum balls 37, from receptacle 12 of bulk vending machine 10 into chute 22 for receipt by a user of machine 10.

6. Continuing with the progress of the coin as coin wheel 120 rotates, after the coin passes washer pawl 131, coin wheel 120 is easily turned until slot 121 is in its starting position aligned with slot 106. It is in this position where return pawl 160 and cam 140 are in their at rest position, as previously discussed.

However, prior to coin wheel 120 being returned to its starting point, the coin is deflected by coin kickout 170 out from slot 121 and into coin retainer 24. Coin kickout 170 is secured to back plate 130 through use of screw 171.

Some final notes regarding the structure of coin mechanism 100, as shown in FIG. 3. First, coin wheel 120 has a plurality of notches 124 into which stroke pin 180 are received. The purpose of notches 124 and stroke pin 180 is to prevent coin wheel 120 from being turned counter-clockwise, so that the user can retrieve his/her coin. In particular, you will note that the bottom surfaces of notches 124 are slanted. Accordingly, it is obvious that stroke pin 180 will slide out from notches 124 along the bottoms of notches 124, from one notch to the next as coin wheel 120 is rotated in a clockwise direction. However, it is equally obvious that stroke pin 180 will hit against the ridges of notches 124, should the user attempt to rotate coin wheel 120 in a counter-clockwise direction.

Stroke pin 180 is held in place through a slot (not shown) in back plate 130 by a spring 181 and screw 182.

Next regarding FIG. 3, coin mechanism 100 is retained within body 20 of bulk vending machine 10 by use of latch 190, which is secured to back plate 130 by a screw 191. Latch 190 is selectively rotatable from its locked position (shown in FIG. 3) to an unlocked position, 90° from the position shown in FIG. 3.

Finally for FIG. 3, front plate 105 and back plate 130 are secured together through use of washers and bolts 195 and 196.

We turn attention now to a first embodiment of data generating device 200 as shown in FIGS. 4-9. Data generating device 200 comprises a bracket 220, switch assembly 230, a data compilation/transfer device 210 (hereinafter referred to as "dctd 210"), and communicating members 216 and 218 for transmission of communications between switch 230 with dctd 210. Communicating members 216 and 218 may be leads secured at one point within a tubular member 219, so as to help keep them from separating or getting tangled with other elements of data generating device 200 or coin mechanism 100. As will be discussed in more detail below, data generating device 200 may not need connecting members 216 and 218, as other types of transmission of the data from switch 230 to dctd 210 may be used, such as, but not limited to, mechanical or radio transmission.

Bracket 220 is specially designed and configured to fit onto coin mechanism 100 at back plate 130 without interfering or in any way hindering the standard operation of coin mechanism 100. In fact, bracket 220 and therefore data generating device 200, is so designed as to allow switch 230 to interact with cam 140 during cam 140's normal operation.

Switch 230 comprises lever 231, pivot connection 232 and button 234. Lever 231 is pivotally mounted around connection 232, and rests upon button 234. It is when button 234 is depressed and then released that dctd 210 advances one number. Lever 231 depresses button 234 when coin wheel 120 is rotated due to rotation of handle 115 and simultaneous rotation of cam 140. FIGS. 8 and 9, in addition to showing how data generating device 200 is attached to back plate 130 by screw 205, show movement of cam 140 from its at rest position in FIG. 8, to its position of depressing lever 231, as shown in FIG. 9.

Figure 6:
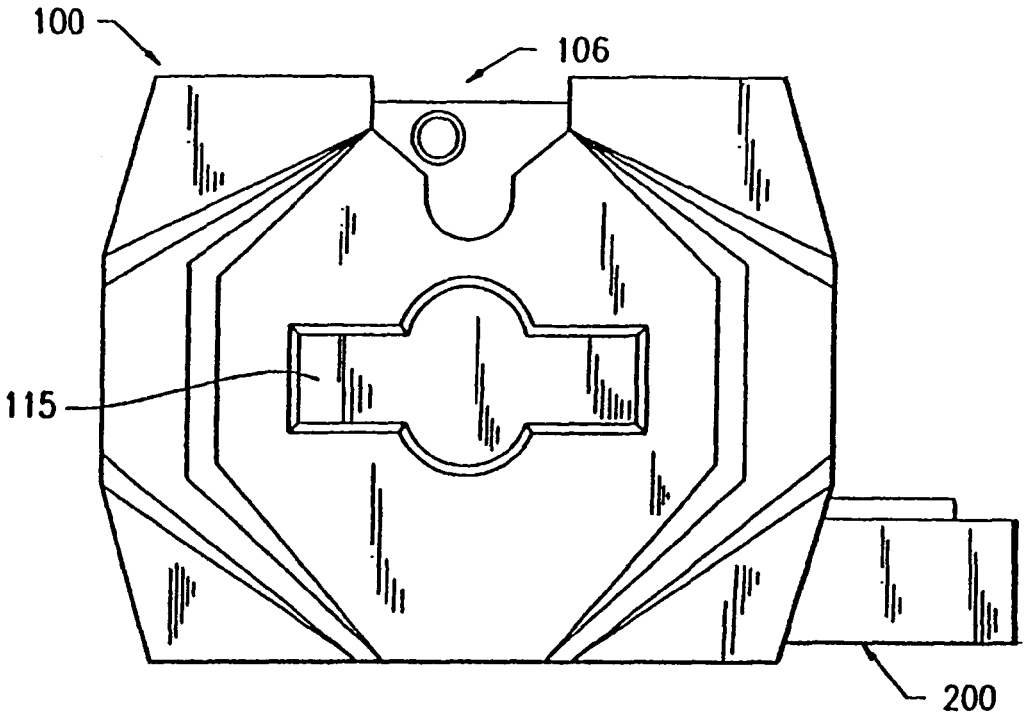
FIG. 6 is a front elevational view of the coin mechanism of FIG. 3, showing the data generating device of FIGS. 4 and 5 extending therefrom.
Figure 7:
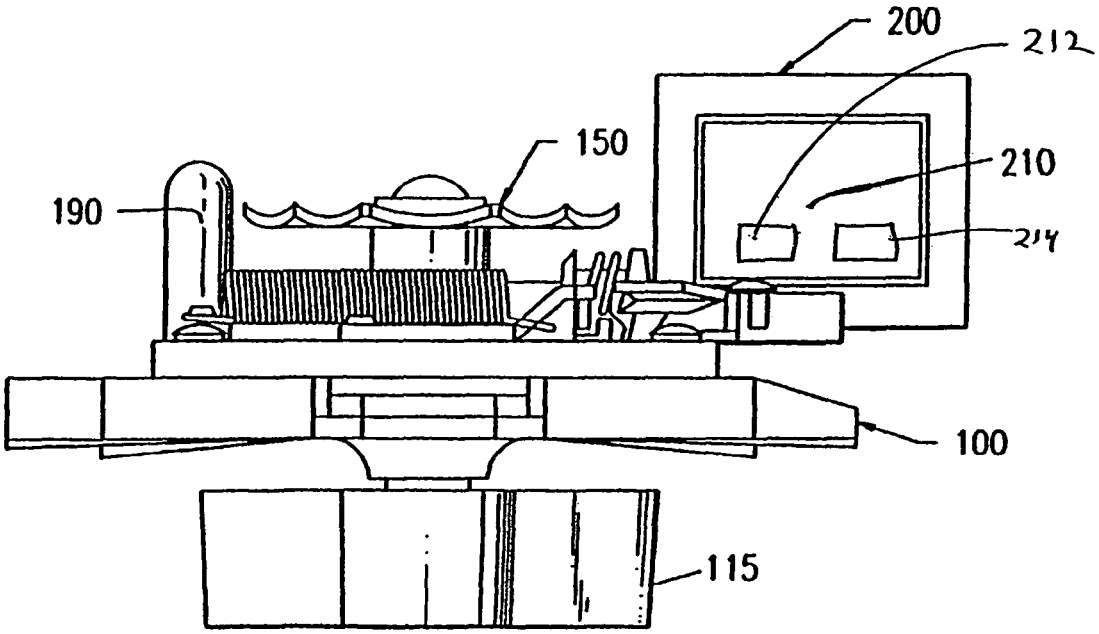
FIG. 7 is a top plan view of the device of FIG. 6.

As seen in FIGS. 1, 6 and 7, even when data generating device 200 is attached to coin mechanism 100 the size of coin mechanism 100 is essentially unchanged thereby allowing data generating device 200 to be used within all bulk vending machines in the limited space provided within body 20, between chute shield 26 and rear plate 130.

Since data generating device 200 is also preferably self-powered by, preferably, a nickel cadmium battery, there is no need to have to position bulk vending machine 10 near an AC power outlet, and the bulk vending industry can continue its practice of positioning these bulk vending machines at inconvenient locations. The lack of an AC power hook-up to power data generating device 200 also increases the safety of the apparatus, since there is no possibility of electric shock to the users of the bulk vending machines.

As will be discussed in more detail below, it is also to be understood that dctd 210 need not actually be attached to bracket 220, but can be located off of coin mechanism 100, and, preferably, directly accessible to operators of machine 10 without the operator needing to open machine 10 and remove, or partially remove, coin mechanism 100.

Turning attention now to dctd 210, in addition to being able to keep track of the number of "vends" for a given bulk vending machine, vending machine, etc., dctd 210 will also be able to store this information on computer chip for later download by the owner/operator. In addition, dctd 210 will also be able to provide other data relevant to the dispensing of "vends" from the machine to an interested owner/operator; such as, but not limited to, day and/or time of particular "vends", particular machine from which the "vend" took place, particular location/owner/operator of machine from which each "vend" originated, the identity of the person collecting the money from the machine, and allow for multiple hook-up of dctds from numerous machines found in one location so as to achieve a report on all "vends."

All of the information available from dctd 210 will be downloadable through output port 212. The available downloaded material will be able to be transported into any spreadsheet program available on the market.

Dctd 210 also has an input port 214, through which the person setting up the mechanism in the vending machine can input data relevant to the particular location/owner/operator, or any other required/needed information. Presumably, such inputted information would also be in whole or in part downloaded with the rest of the data, so as to make any report issued therefrom as complete as possible.

As has been mentioned above, it is also to be understood from the invention that dctd 210 is not necessarily an integrally attached component of data generating device 200, located within opening 21 of machine 10. In the alternative, dctd 210 may be connected remotely, by long communication members, for example, lead wires 216 and 218 as shown in FIG. 8, or possibly even through radio transmission by antenna 270 as shown in FIG. 9, to switch 230. Part of the determination of the location of dctd 210 will depend upon the user/owner/operator and how he/she will want to access output and input ports 212 and 214.

Figure 10:
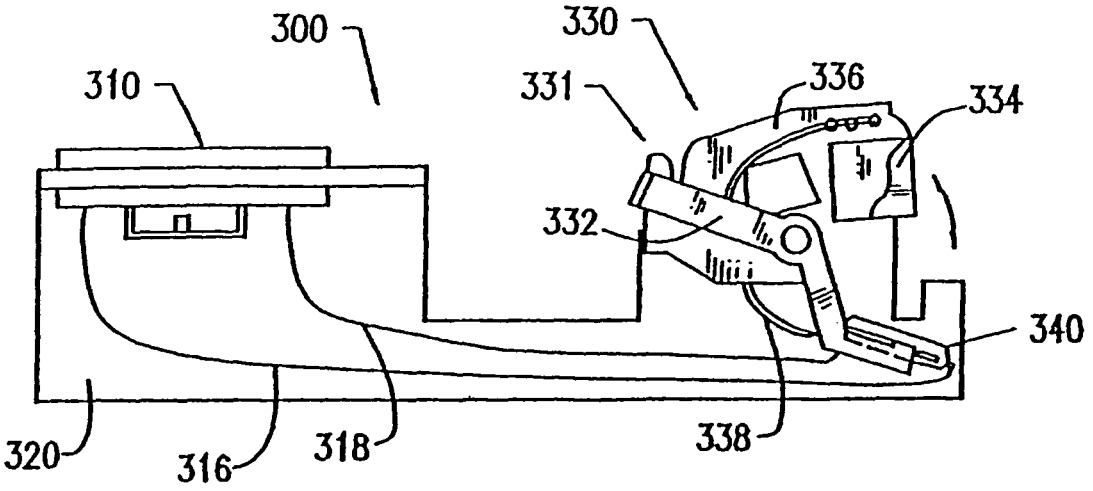
FIG. 10 is a front elevational view of a second embodiment of a data generating device made in accordance with the invention showing the magnet arm in its open, at-rest, position.
Figure 11:
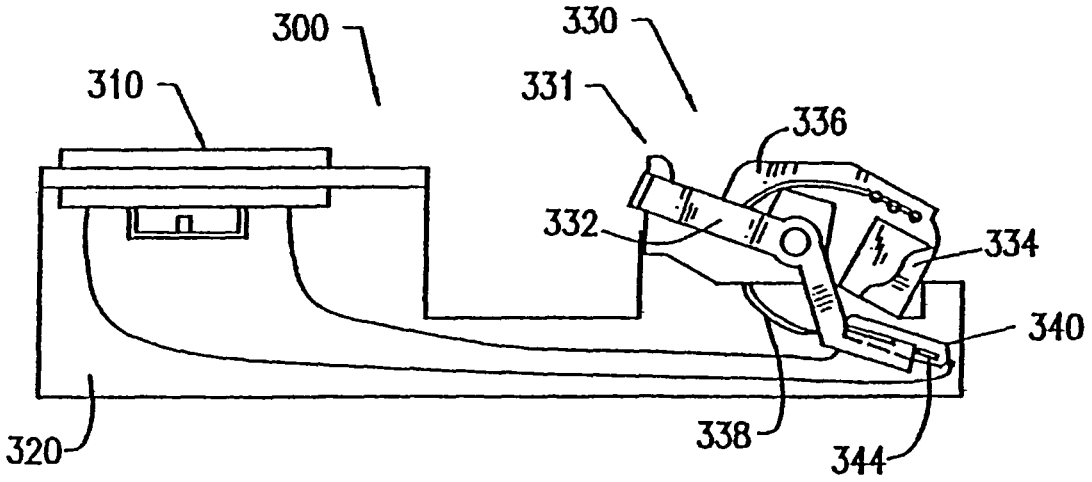
FIG. 11 is a front elevational view of a second embodiment of the data generating device of FIG. 10, showing the magnet arm in its closed position.

Directing our attention now to a discussion of a second embodiment of the invention, data generating device 300 (as seen in FIGS. 10 and 11), is attached to coin mechanism 100 in substantially the same manner as data generating device 200, shown in FIGS. 6-9. Data generating device 300 has a dctd 310 mounted on a bracket 320, as are communicating members 316 and 318, and as is reed-switch assembly 330.

As with bracket 220 of the first embodiment of the invention, bracket 320 is a specially designed and configured to fit onto coin mechanism 100 at back plate 130 without interfering or in any way hindering the standard operation of coin mechanism 100. In fact, bracket 320 and therefore data generating device 300, are so designed as to allow reed-switch assembly 330 to interact with cam 140 during cam 140's normal operation.

Reed-switch assembly 330 comprises a bracket assembly 331, a reed-switch 340 and a spring assembly 338. Bracket assembly 331 comprises a first arm 332, having the reed-switch 340 attached thereto at a first end thereof, and a second arm 336 having a magnet 334 attached thereto at a first end thereof. Spring assembly 338 is attached between first arm 332 and second arm 336. First arm 332 is substantially fixed in its attachment to bracket 320, while second arm 336 is selectively pivotal in its attachment to bracket 320.

Due to the pivotal nature of second arm 336, spring assembly 338 is tensioned in such a way so as to hold second arm 336 in an open relationship to first arm 332 when reed-switch assembly 330 is in its at-rest (open) position, as shown in FIG. 10.

Figure 12:
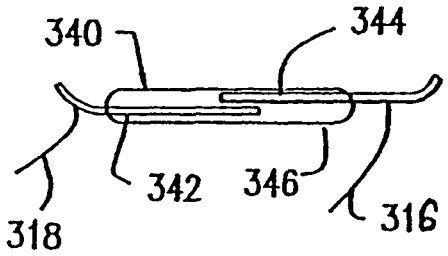
FIG. 12 is a top plan view of a reed-switch.

As is best shown in FIG. 12, reed-switch 340 comprises first and second metal strips 342 and 344 held within a glass tube 346. Strip 342 extends from tube 346 and has attached thereto lead 318, while strip 344 extends from another side of tube 346 and has attached thereto lead 316.

As seen in FIG. 12, a gap exists between strips 342 and 344 when reed-switch 340 is in an at-rest state. However, once cam 140 rotates the eccentric portion thereof touches and pushes pivotal second arm 336, closing reed-switch assembly 330 and bringing magnet 334 proximate to reed-switch 340, causing strips 342 and 344 to touch within tube 346. Upon the touching of strips 342 and 344, dctd 310 records a data entry, as for example, a numeric count of the distributed vend.

Figure 13:
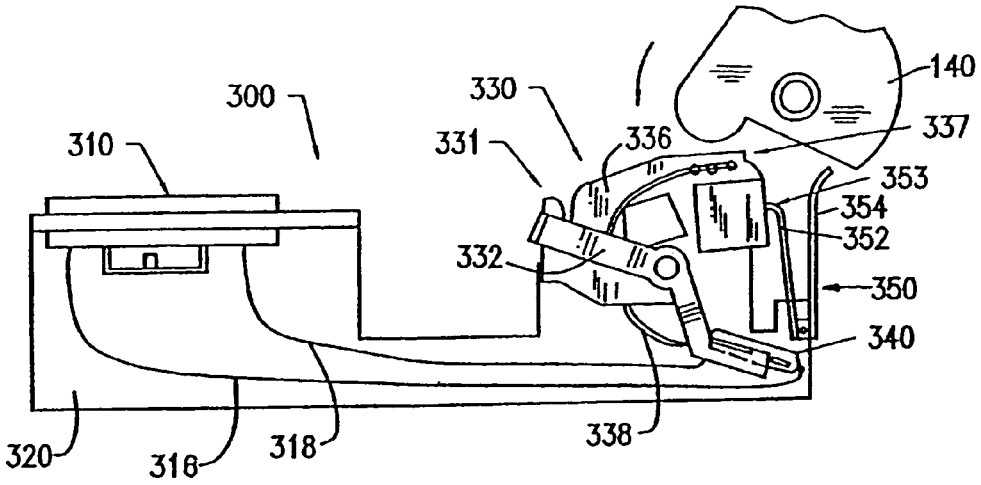
FIG. 13 is a front elevational view of a second embodiment of a data generating device made in accordance with the invention, showing a release mechanism in an inactive, at-rest, state.
Figure 14:
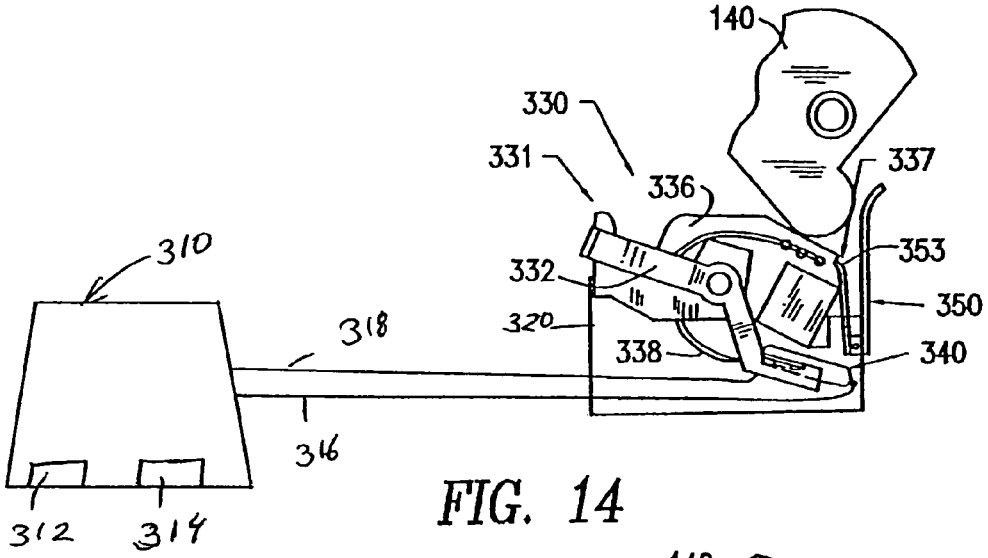
FIG. 14 is a front elevational view of a second embodiment of a data generating device made in accordance with the invention, showing the release mechanism of FIG. 13 in an activated state.
Figure 15:
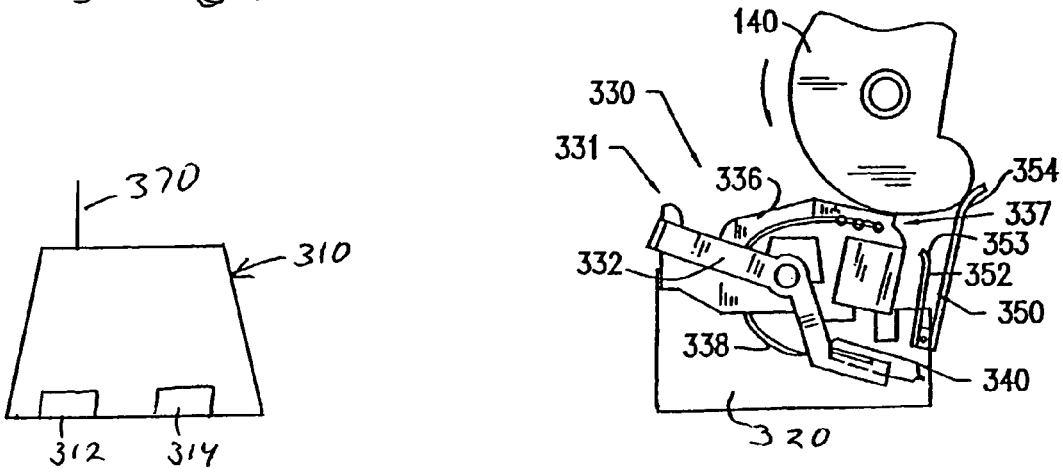
FIG. 15 is a front elevational view of a second embodiment of a data generating device made in accordance with the invention, showing the release mechanism of FIG. 13 in the state of being released.

The rotation of cam 140 is shown in FIGS. 13-15, along with the associated movements of reed-switch assembly 330. In FIG. 13, the eccentric portion of cam 140 is just about to touch the top of second arm 336, which is in its at-rest position. In FIG. 14, cam 140 is seen closing reed-switch assembly 330, to bring magnet 334 into proximate orientation with reed-switch 340, causing dctd 310 to record a data entry. In FIG. 15, cam 140 is shown continuing in its rotation, by which the eccentric shape of cam 140 allows second arm 336 to return to its at-rest, open position. The counting process will start again upon a user of machine 10 depositing a coin and turning handle 115, thereby again causing cam 140 to rotate.

As was previously discussed with respect to the first embodiment, even when data generating device 300 is attached to coin mechanism 100 the size of coin mechanism 100 is essentially unchanged thereby allowing data generating device 300 to be used within all bulk vending machines in the limited space provided within body 20, between chute shield 26 and rear plate 130.

Since data generating device 300 is also preferably self-powered by, preferably, a nickel cadmium battery, there is no need to have to position bulk vending machine 10 near an AC power outlet, and the bulk vending industry can continue its practice of positioning these bulk vending machines at inconvenient locations. The lack of an AC power hook-up to power data generating device 300 also increases the safety of the apparatus, since there is no possibility of electric shock to the users of the bulk vending machines.

As has been mentioned above for the first embodiment, it is also to be understood from the invention that dctd 310 is not necessarily an integrally attached component of data generating device 300, located within opening 21 of machine 10. In the alternative, dctd 310 may be connected remotely, by long communication members, for example, lead wires 316 and 318 as shown in FIG. 14, or possibly even through radio transmission by antenna 370 as shown in FIG. 15, to reed-switch assembly 330. Part of the determination of the location of dctd 310 will depend upon the user/owner/operator and how he/she will want to access output and input ports 312 and 314.

Turning now to a further discussion of FIGS. 13-15, it is seen that data generating device 300 is also equipped with a release mechanism 350. Release mechanism 350 has securing arm 352 and release arm 354. Securing arm 352 has a first end 353, designed to be received within a notch 337 of second arm 336 of reed-switch assembly 330, as is best seen in FIG. 14.

In operation, release mechanism 350 slides along an edge of second arm 336 as cam 140 closes assembly 330 (FIG. 13). Once assembly 330 is closed (FIG. 14), first end 353 is received within notch 337, securing reed-switch assembly 330 in the closed condition so as to prevent substantially all possibility of double counting due to the shaking of machine 10 or of the jiggling of handle 115 by the user. Only after cam 140 continues its rotation to a position away from its position causing assembly 330 to close (FIG. 15), does cam 140 touch release arm 354, thereby rotating release mechanism 350 so that end 353 of arm 352 is removed from notch 337, allowing second arm 336 to jump away from its closed position due to the pulling action of spring assembly 338.

Release assembly 350 is attached to bracket 320 in such a way as to cause end 353 to be tensioned against the edge of second arm 336 when assembly 350 is in its at-rest position shown in FIG. 13.

Figure 16:
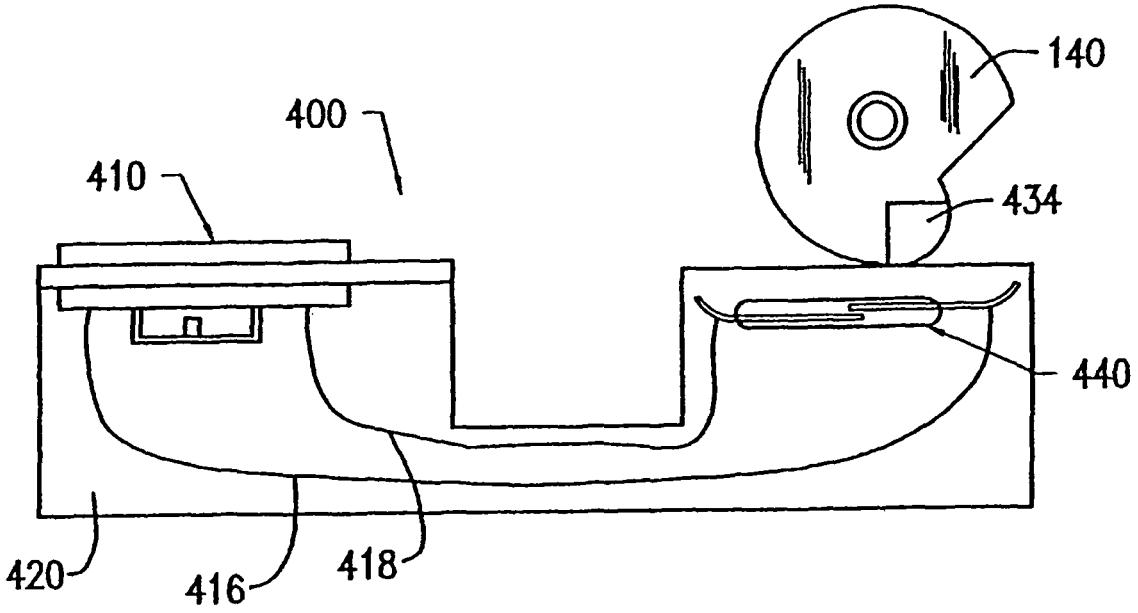
FIG. 16 is a front elevational view of a third embodiment of a data generating device made in accordance with the invention.

Turning now to a discussion of a third embodiment of the invention as shown in FIG. 16, a magnet/reed-switch structure similar to that of the second embodiment is used to cause the generation of data for the device. Here, a data generating device 400 is attached to coin mechanism 100 and has a dctd 410. Dctd 410 can be mounted on a first side of a bracket 420, while communicating members (preferably leads) 416 and 418 extend between reed-switch 440, mounted on a second side of the bracket 420, and dctd 410.

The only difference in the functioning of the data generating device of the third embodiment from the data generating device of the second embodiment is that data generating device 400 does not need the complicated pivotal arm assembly of reed-switch assembly 330. Instead, a magnet 434 is attached to the eccentric portion of cam 140 (FIG. 16) and a reed-switch 440 is attached to bracket 420 in such a way as to be proximate to the eccentric portion of cam 140 when cam 140 is rotated into the position shown in FIG. 16. Since reed-switch 440 works in the identical manner as reed-switch 340, when magnet 434 is brought into proximity with reed-switch 440 by the rotation of cam 140, the strips of the reed-switch close and touch causing the data generating device to advance one number.

Figure 17:
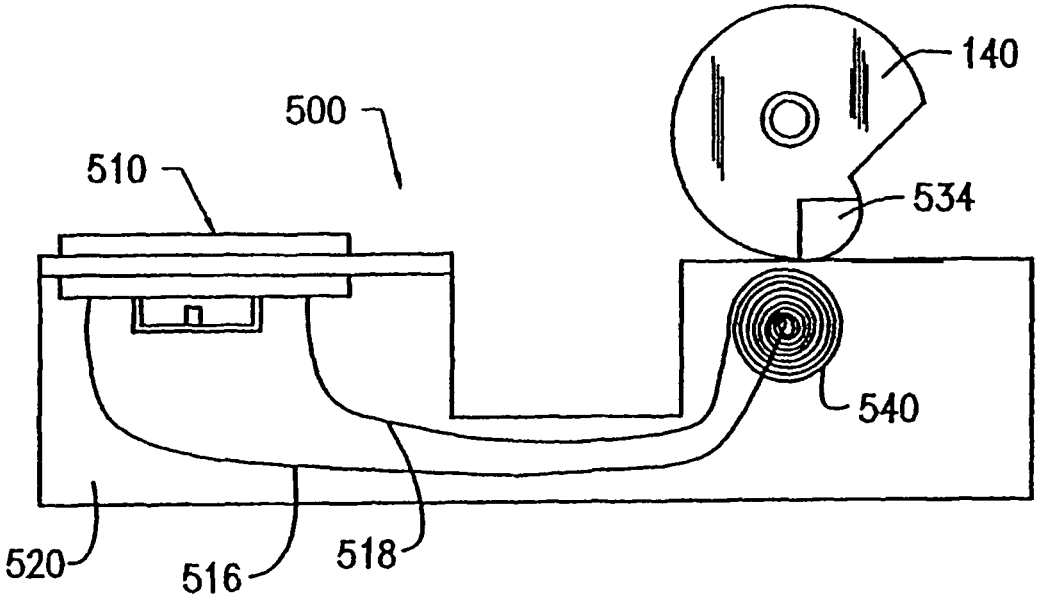
FIG. 17 is a front elevational view of a fourth embodiment of a data generating device made in accordance with the invention.

Turning now to a discussion of a fourth embodiment of the invention as shown in FIG. 17, a metal piece/inductive coil structure similar in operation to that of the third embodiment is used to cause the data generation of the device. Here, a data generating device 500 is attached to coin mechanism 100 and has a dctd 510. Dctd 510 is mounted on a bracket 520, while communicating members (preferably leads) 516 and 518 extend between inductive coil 540, mounted on a second side of the bracket 420, and dctd 410.

The data generating device of the fourth embodiment operates the same as that of the third embodiment in that cam 140 is used to carry one part of the data generating device assembly, while the other part is attached to the bracket in such a way as to allow the cam-carried part to come close to this other bracket-mounted part thereby causing the counting to take place. In the fourth embodiment device, instead of a magnet mounted on the cam, a piece of metal 534 is attached to the eccentric portion of cam 140. In addition, instead of the reed-switch 440 of the third embodiment, an inductive coil 540 is attached to bracket 520 in such a way as to be proximate to the eccentric portion of cam 140 when cam 140 is rotated into the position shown in FIG. 17. When metal piece 534 is brought into proximity with inductive coil 540 by the rotation of cam 140, the magnetic field around inductive coil 540 is disturbed, thereby cause a signal to be sent through data generating device 500 along communicating members 516 and 518 causing the data generating device to generate data.

For both of the fourth and fifth embodiments of FIGS. 16 and 17, dctd 410/510 does not need to be directly attached to bracket 420/520, but can instead be remotely mounted using long communications members and/or a radio transmission device similar to those shown and discussed in relation to the prior embodiments.

It will thus be seen that the objects set forth above, among those made apparent from the preceding description, are efficiently attained, and since certain changes may be made in the above constructions without departing from the spirit and scope of the invention, it is intended that all matter contained in the above description and shown in the accompanying drawings shall be interpreted as illustrative, and not in a limiting sense.

It is also to be understood that the following claims are intended to cover all of the generic and specific features of the invention herein described and all statements of the scope of the invention, which, as a matter of language, might be said to fall therebetween.

What is claimed is:

1. A data generating device for a bulk vending machine having a coin mechanism having a selectively rotatable cam, comprising:

a data compilation/transfer device; and a switch assembly in communication with said data compilation/transfer device;

wherein said switch assembly is attached to said coin mechanism of said bulk vending machine in such a way that a portion of said switch is contacted by a portion of said cam when said cam rotates, causing said switch to close thereby causing said data compilation/transfer device to compile data.

2. A data generating device as recited in claim 1, wherein said data compilation/transfer device is self-powered by an attached battery.

3. A data generating device for a bulk vending machine having a coin mechanism having a selectively rotatable cam, comprising:

a data compilation/transfer device; and a reed-switch assembly in communication with said data compilation/transfer device, comprising:

a bracket assembly having a first substantially fixed arm and a second selectively pivotal arm;

a reed-switch attached to said first arm at a first end thereof;

a magnet attached to said second arm at a first end thereof; and a spring assembly attached between said first and second arms, positioning said second arm in an open relationship to said first arm for an at-rest position of said reed-switch assembly;

wherein said reed-switch assembly is attached to said coin mechanism in such a way that rotation of said cam causes an eccentrically shaped portion of said cam to cause said second arm of said reed-switch assembly to pivot, closing said reed-switch assembly and bringing said magnet proximate to said reed-switch thereby causing said data compilation/transfer device to compile data.

4. A data generating device as recited in claim 3, wherein said data compilation/transfer device is self-powered by an attached battery.

5. A data generating device for a bulk vending machine having a coin mechanism having a selectively rotatable cam, comprising:

a data compilation/transfer device; and a reed-switch attached to said coin mechanism in such a position as to be in a working relationship with a magnet attached to an eccentric portion of said cam, when said magnet is proximate to said reed-switch because of said rotation of said cam;

wherein said data compilation/transfer device compiles data when said magnet is rotated proximate to said reed-switch by said cam.

6. A data generating device as recited in claim 5, wherein said data compilation/transfer device is self-powered by an attached battery.

7. A data generating device for a bulk vending machine having a coin mechanism having a selectively rotatable cam, comprising:

a data compilation/transfer device; and an inductive coil attached to said coin mechanism in such a position as to be in a working relationship with a metal piece attached to an eccentric portion of said cam, when said metal piece is proximate said inductive coil because of said rotation of said cam;

wherein said data compilation/transfer device compiles data when said metal piece is rotated proximate to said inductive coil by said cam.

8. A data generating device as recited in claim 7, wherein said data compilation/transfer device is self-powered by an attached battery.

* * * * *